US010633931B1

(12) United States Patent
Burns

(10) Patent No.: US 10,633,931 B1
(45) **Date of Patent: *Apr. 28, 2020**

(54) SUPPORT APPARATUS FOR SUPPORTING DOWN HOLE ROTARY TOOLS

(71) Applicant: SWIVEL RENTAL & SUPPLY, L.L.C., Lafayette, LA (US)

(72) Inventor: Douglas C. Burns, Lafayette, LA (US)

(73) Assignee: SWIVEL RENTAL & SUPPLY, L.L.C., Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/385,895

(22) Filed: Apr. 16, 2019

Related U.S. Application Data

(63) Continuation of application No. 15/910,486, filed on Mar. 2, 2018, now Pat. No. 10,301,884, which is a continuation of application No. 15/482,364, filed on Apr. 7, 2017, now Pat. No. 9,938,778, which is a continuation of application No. 14/277,916, filed on May 15, 2014, now Pat. No. 9,650,841, which is a continuation of application No. 12/833,057, filed on Jul. 9, 2010, now Pat. No. 8,793,960.

(60) Provisional application No. 61/277,529, filed on Sep. 25, 2009.

(51) Int. Cl.
*E21B 15/00* (2006.01)
*E21B 7/02* (2006.01)

(52) U.S. Cl.
CPC ..... *E21B 15/003* (2013.01); *E21B 7/02* (2013.01)

(58) Field of Classification Search
CPC . E21B 7/02; E21B 7/023; E21B 15/00; E21B 15/003
See application file for complete search history.

(56) References Cited

U.S. PATENT DOCUMENTS

| | | | | |
|---|---|---|---|---|
| 2,981,346 | A | 4/1961 | Bauer et al. | |
| 3,857,451 | A | 12/1974 | Williams | |
| 3,949,818 | A | 4/1976 | Russell | |
| 3,960,360 | A | 6/1976 | Elliston | |
| 4,069,879 | A * | 1/1978 | Brown | E21B 19/20 175/57 |
| 4,208,158 | A | 6/1980 | Davies et al. | |
| 4,479,537 | A | 10/1984 | Reed | |
| 4,757,592 | A | 7/1988 | Reed | |
| 4,844,660 | A | 7/1989 | Ortemond | |

(Continued)

FOREIGN PATENT DOCUMENTS

EP 0312286 4/1989

OTHER PUBLICATIONS

Swivel stand in public use in US in 2002.

(Continued)

*Primary Examiner* — Ryan D Kwiecinski
(74) *Attorney, Agent, or Firm* — Garvey, Smith & Nehrbass, Patent Attorneys, L.L.C.; Seth M. Nehrbass; Fabian M. Nehrbass

(57) ABSTRACT

A portable mast assembly is comprised of a skid assembly having a horizontally oriented frame comprised of longitudinally extending support beams and a mast assembly having at least two vertically extending columns that are supported directly upon a longitudinally extending mast beam without an intervening track or roller. A means for moving the mast beams along the top of the extending support beams of the frame without a roller is provided.

20 Claims, 13 Drawing Sheets

(56) References Cited

U.S. PATENT DOCUMENTS

| | | | | |
|---|---|---|---|---|
| 5,211,251 | A | 5/1993 | Woolslayer | |
| 5,372,353 | A | 12/1994 | West | |
| 5,467,833 | A * | 11/1995 | Crain | E21B 19/002 166/338 |
| 5,667,013 | A | 9/1997 | Bain | |
| 6,357,528 | B1 | 3/2002 | Davis et al. | |
| 6,675,899 | B2 * | 1/2004 | Coats | E21B 15/02 166/379 |
| 7,419,006 | B2 * | 9/2008 | Armstrong | E21B 41/0021 166/338 |
| 7,527,100 | B2 * | 5/2009 | Abadie | E21B 29/00 166/298 |
| 7,921,918 | B2 * | 4/2011 | Bryant, Jr. | E21B 29/12 166/351 |
| 8,235,126 | B2 * | 8/2012 | Bradley | E21B 41/00 166/379 |
| 8,793,960 | B1 | 8/2014 | Burns | |
| 9,217,297 | B2 | 12/2015 | Burns | |
| 9,650,841 | B2 | 5/2017 | Burns | |
| 2002/0046661 | A1 | 4/2002 | Hawkins | |
| 2002/0074125 | A1 * | 6/2002 | Fikes | E21B 15/003 166/352 |
| 2007/0068669 | A1 * | 3/2007 | Lesko | E21B 19/163 166/77.51 |
| 2008/0066928 | A1 * | 3/2008 | Thomas, Jr. | E21B 3/04 166/380 |
| 2009/0126941 | A1 * | 5/2009 | Laitolais, Jr. | E21B 19/24 166/377 |
| 2011/0073298 | A1 * | 3/2011 | Thompson | E21B 33/02 166/75.11 |
| 2011/0247290 | A1 * | 10/2011 | Beck | E21B 7/023 52/651.05 |

OTHER PUBLICATIONS

Swivel stand in public use in US in 2006.

Superior Energy Services Brochure, Nov. 2008.

Defendants' Invalidity Contentions and Exhibits thereto, *Swivel Rental & Supply, LLC* vs. *Petro Pull, LLC et al*., USDC WDLA 6:18-01141, dated Oct. 7, 2019 (U.S. Pat. Nos. 3,857,451; 3,949,818; 4,757,592; 5,667,013; and 7,527,100; US Patent App. Pub. No. 2002/0046661; and EP Pub. No. 0 312 286 are omitted).

Defendants' Second Amended and Supplemental Counterclaims, *Swivel Rental & Supply, LLC* vs. *Petro Pull, LLC et al*., USDC WDLA 6:18-01141, dated Nov. 1, 2019 (Rec. Doc. 47-10).

Documents produced by Defendants in *Swivel Rental & Supply, LLC* vs. *Petro Pull, LLC et al*., USDC WDLA 6:18-01141, on Nov. 7, 2019 (identified as Bates DEF-0083 to DEF 0122).

* cited by examiner

SUPPORT APPARATUS FOR SUPPORTING DOWN HOLE ROTARY TOOLS

PRIORITY

This application is a continuation of U.S. patent application Ser. No. 15/910,486 filed 2 Mar. 2018 (now U.S. Pat. No. 10,301,884), which is a continuation of U.S. patent application Ser. No. 15/482,364 filed 7 Apr. 2017 (now U.S. Pat. No. 9,938,778), which is a continuation of U.S. patent application Ser. No. 14/277,916 filed 15 May 2014 (now U.S. Pat. No. 9,650,841), which is a continuation of U.S. patent application Ser. No. 12/833,057 filed 9 Jul. 2010 (now U.S. Pat. No. 8,793,960), which claims the benefit of priority to U.S. Provisional Application No. 61/277,529 filed 25 Sep. 2009, each of which is incorporated by reference.

FIELD OF THE INVENTION

This invention relates generally to an adjustable linear support structure traversable in two axes. More particularly it relates to a support structure positional adjacent a wellhead. The structure can be used for multiple purposes including supporting, extending and retracting rotating tools and extracting drill casing from wells during plug and abandon operations.

GENERAL BACKGROUND

The drilling process for oil and gas exploration typically requires the installation of production tubing that extends from the underground oil and gas reservoir to the well surface. This production tubing serves as a conduit for the recovery of the oil and gas from the reservoir. The production tubing is typically placed in a protective pipe liner called a tubular casing. The tubular casing, in descending diameters, extends in many cases to hundreds of feet and is often cement is placed within the annulus located between the tubular casing and the well bore to hold the tubular casing in place and to ensure a pressure-tight connection between the well surface and the oil and gas reservoir.

Usually the tubular casing remains within the well bore until it has been determined that no oil or gas reservoirs have been found or the reservoirs have been exhausted. In such cases, the well bore must be plugged and abandoned (P & A) as required by law or convention. When a well bore is plugged and abandoned, the casing tubular is typically removed to a desired or prescribed depth and disposed of in a safe manner.

In other cases, an existing well bore is often utilized to allow the well to be drilled in a different direction. Often in such cases, the drill bit being used to advance the drilling cannot pass through the previously installed tubular casing due to an obstruction. If that occurs, it is necessary to remove the casing tubular to a desired depth before drilling operations can be restarted.

In most wells there are at least four tubular strings, beginning with the largest, upper and outer most conductor pipe, the surface casing, the intermediate tubular and finally the production casing. The removal of the tubular casing when required is often very difficult due to the tremendous weight of the tubular strings and, in some cases, the cement that has been placed around and between the various tubular strings.

The removal of the tubular casing from the well, such as when a well is to be plugged and abandoned, generally begins by first inspecting the well and insuring that the well is inactive and free of any residual gas and that the well is safe to allow for removal of the blowout preventers, well head, and other well equipment that is positioned above the tubing hangers. A safe work platform is then established around the wellhead and associated equipment. That work platform is then used to create a bridge plug within the production tubular at a prescribed depth by applying cement to seal or plug the well casing. The production tubular is then cut at a prescribed depth below the surface using chemical cut, jet cut, mechanical cut or other such rotating cutting tools. The cutting tool is supported on the surface and rotated by a rotary swivel. A lifting device is then attached to the inner most tubular by screwing into or spearing the tubular tubing hanger.

Such lifting devices may be the rig's crane if available and not in use by other drilling operations on the site. The production tubular is then lifted to a desired length, usually approximately forty feet, where slips are set to hold the string and tongs are used to uncouple the tubular joints. However, in many cases the drill casing tubular cannot be uncoupled in this manner. In the latter case, two diametrically opposing holes are cut in the casing and a bar is then inserted through the holes and the lifting device, such as a crane, is slaked off to allow the bar to rest on top of the well flange. The tubular is then flame cut just above the bar and the initial section of tubular is then removed. In some cases, where cement is present between the tubular strings, it becomes necessary to chip away the cement in order to cut the lifting bar holes. The crane then returns and is attached to the bar thus lifting the tubular string for another length and holes are again cut for a lifting bar. The process described above is then repeated for each tubular string until all the tubulars are removed.

Each incremental section of tubular usually requires operators to cut the casing, usually by torch, and manually drill two holes. The two holes are drilled from each side of the tubular in an attempt to keep them aligned with each other. It is essential that the holes be aligned with each other or large enough so that the bar or rod can be placed through the two holes. As discussed above, raising the tubular requires an extensive amount of force to overcome the resisting forces. Therefore, a stable platform is required. After the various increments of casing tubular are cut and pulled from the well bore, they are disposed of in a prescribed manner. Where holes drilled for the bars are individually and sequentially drilled in each incremental section of casing it is essential that proper tooling be used to maintain alignment. The operators usually drill one side at a time, a slow and tedious process, especially with heavy gauge pipe. In some cases up to two hours is required. The operator is required to drill a second hole that is diametrically opposite the first. In some cases the operator is fortunate enough to get the two holes lined up, but at other times the two holes did not line up and a bar could not be inserted through both holes in which case a torch is used to enlarge at least one of the holes so that the bar could be placed through both holes.

A dual drill system that drills holes from both sides simultaneously thereby insuring alignment may be used. Although the time required to drill the holes may be drastically reduced in such cases, a significant amount of time is still required to set up, and to dear, lubricate, and repair the drill bits. In addition, a torch is still often used to cut each section of the tubular being removed. Since a torch is used to separate the tubular into reasonable lengths, it has become more prevalent to simply cut the holes with a torch as well.

In view of the process described above, a faster and more efficient method is needed to perform these tasks with greater certainty.

In more recent years the P & A operation has included the use of a portable power swivel to assist in cutting casing down hole for removal. Such power swivels are generally portable hydraulic systems used on a well site having multiple well heads and where existing cranes are not always available for the P & A operation. Therefore, a temporary derrick must be erected adjacent the wellhead to be removed and the P & A operation carried out using the power swivel. Such derricks may or may not include a means for raising the well casing. In most cases a simple frame to support well casing cutting tools is sufficient to separate sections of the well casing. Such frames have evolved from a simple "A" frame structure to more complicated wellhead adapted frames having a vertical mast traversable in at least two planes.

However, in most cases the frames are fitted so as to include a power swivel and its cutting tools. However, in many cases such adaptation to an offshore wellhead is not necessary on well sites having multiple well heads. Such sites have very limited space available and therefore the size of the temporary derrick must be restricted. Therefore, a simple skid having traversable mast to support a plurality of tools is all that is needed. There a power swivel may be one of several tools that may be adapted to the mast, thereby making the skid and mast assembly much more universal.

While certain novel features of an embodiment of this invention are described below and pointed out in the drawings and annexed claims, the invention is not intended to be limited to the details specified herein, since a person of ordinary skill in the relevant art will understand that various omissions, modifications, substitutions and changes in the forms and details of the device illustrated and in its operation may be made without departing in any way from the scope of the present invention. No feature of the invention is critical or essential unless it is expressly stated as being "critical" or "essential."

SUMMARY OF THE INVENTION

The instant invention relates to a portable horizontally oriented skid. The skid supports a vertically oriented mast assembly. The mast assembly is comprised of at least two column assemblies that may be extended or retracted vertically as desired. The position of the mast assembly on the skid may be translatable horizontally without the need for tracks or rollers. The skid is positionable adjacent a wellhead for the purpose of performing P & A operations.

The skid may include a power swivel and other such hydraulic or mechanical tools. The skid when provided with such tools may be used for removing and plugging well casing strings, milling pipe strings, cement drilling, removing wellhead assemblies, or setting and pulling plugs from pipe strings. The skid includes fully enclosed hydraulic rams and may also include a pivotal swivel crane for supporting power tongs.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

Figure 8:
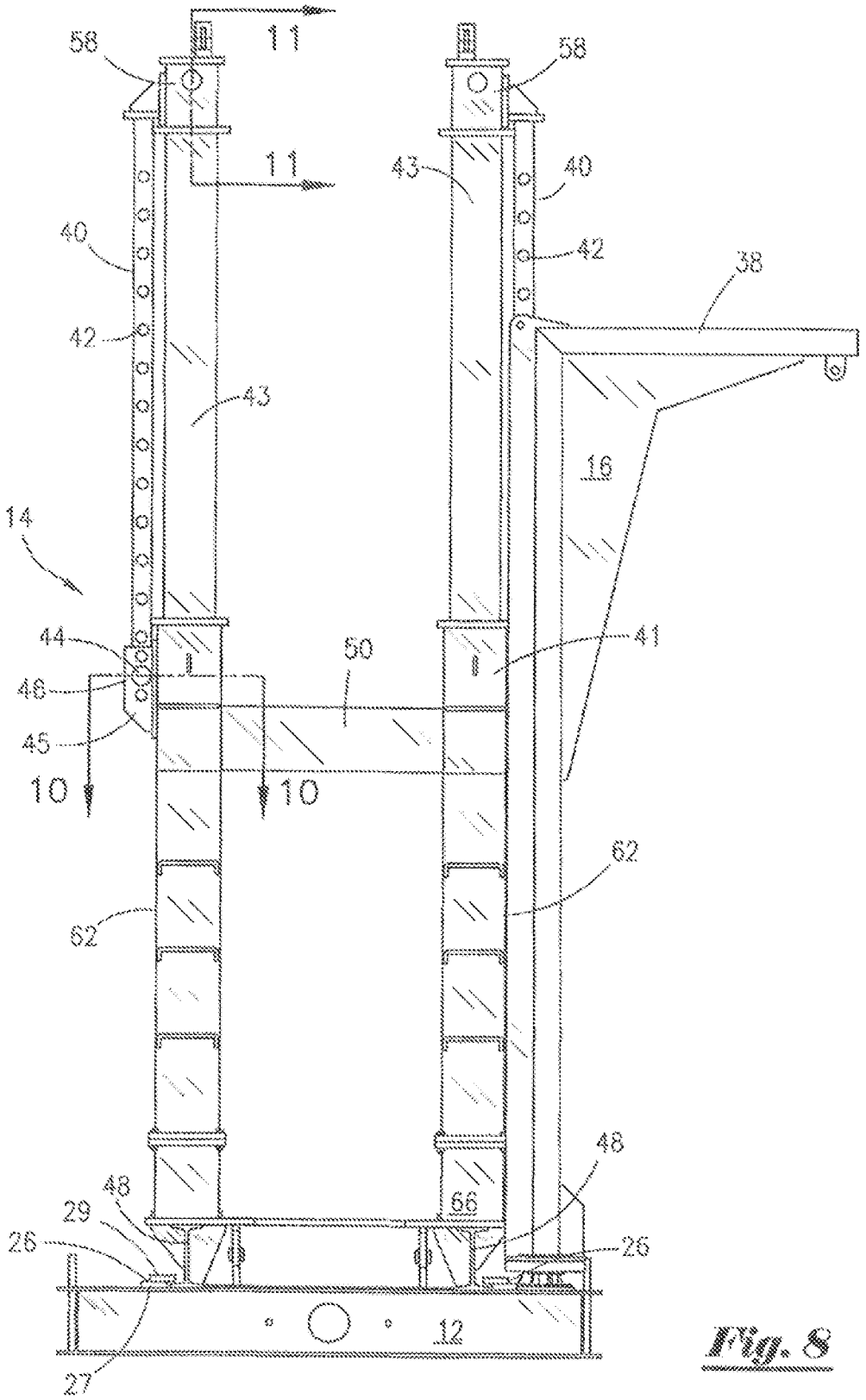
FIG. 8 is a front elevation view of the frame assembly with the column assembles of the mast assembly extended vertically and pinned.

FIG. to is a partial cross sectional view taken along sight lines 10-10 as seen in FIG. 8.

Figure 11:
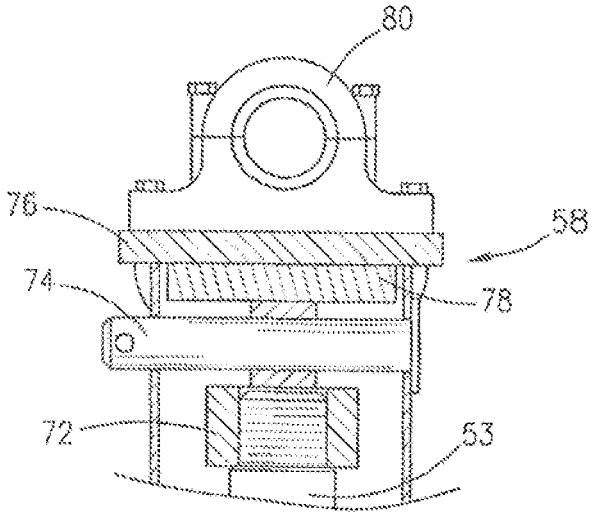

FIG. 11 is a partial cross sectional view taken along sight lines 11-11 as seen in FIG. 8.

Figure 12:
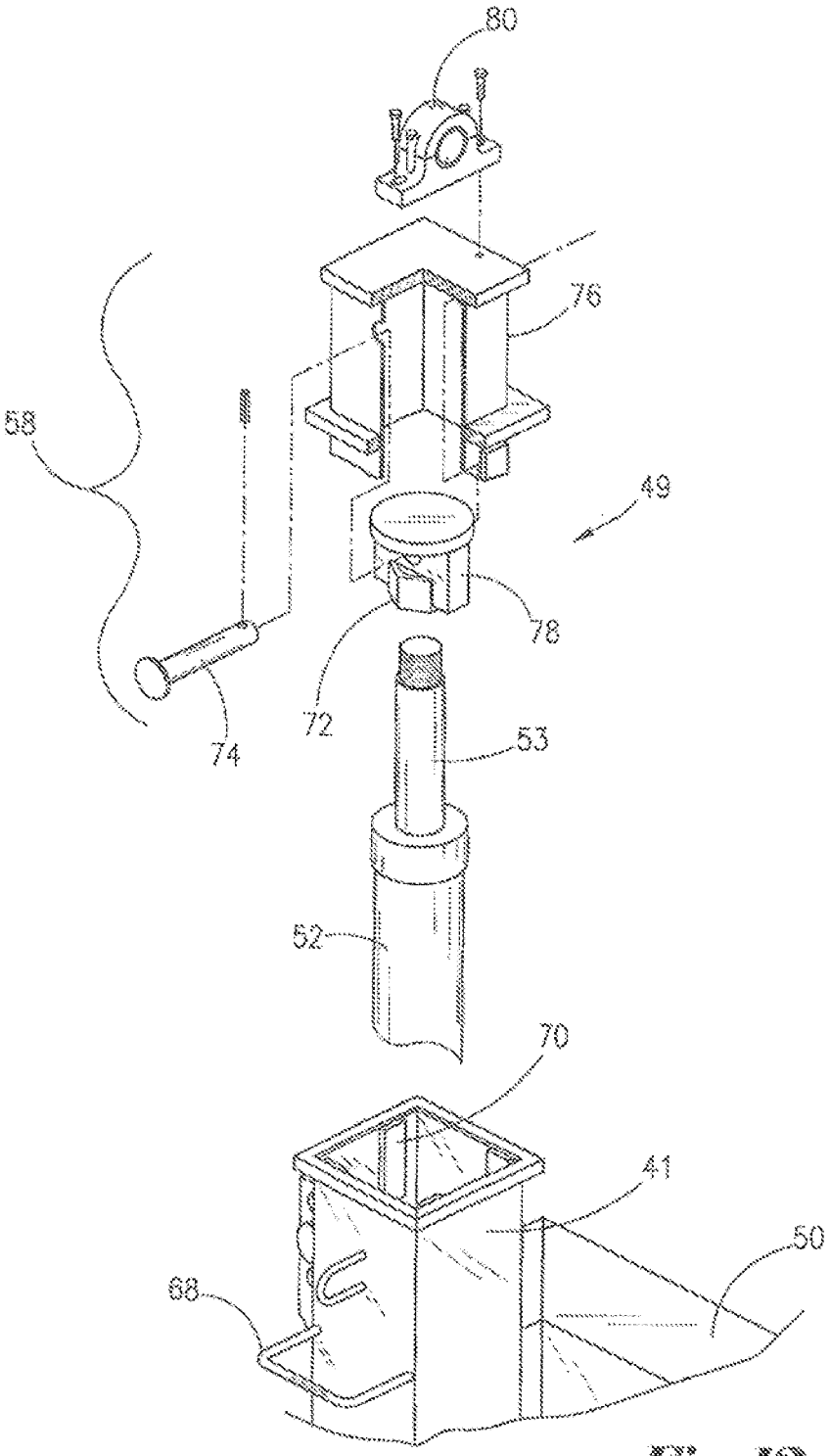

FIG. 12 is a partial exploded view of the extender head and bearing assembly.

Figure 13:
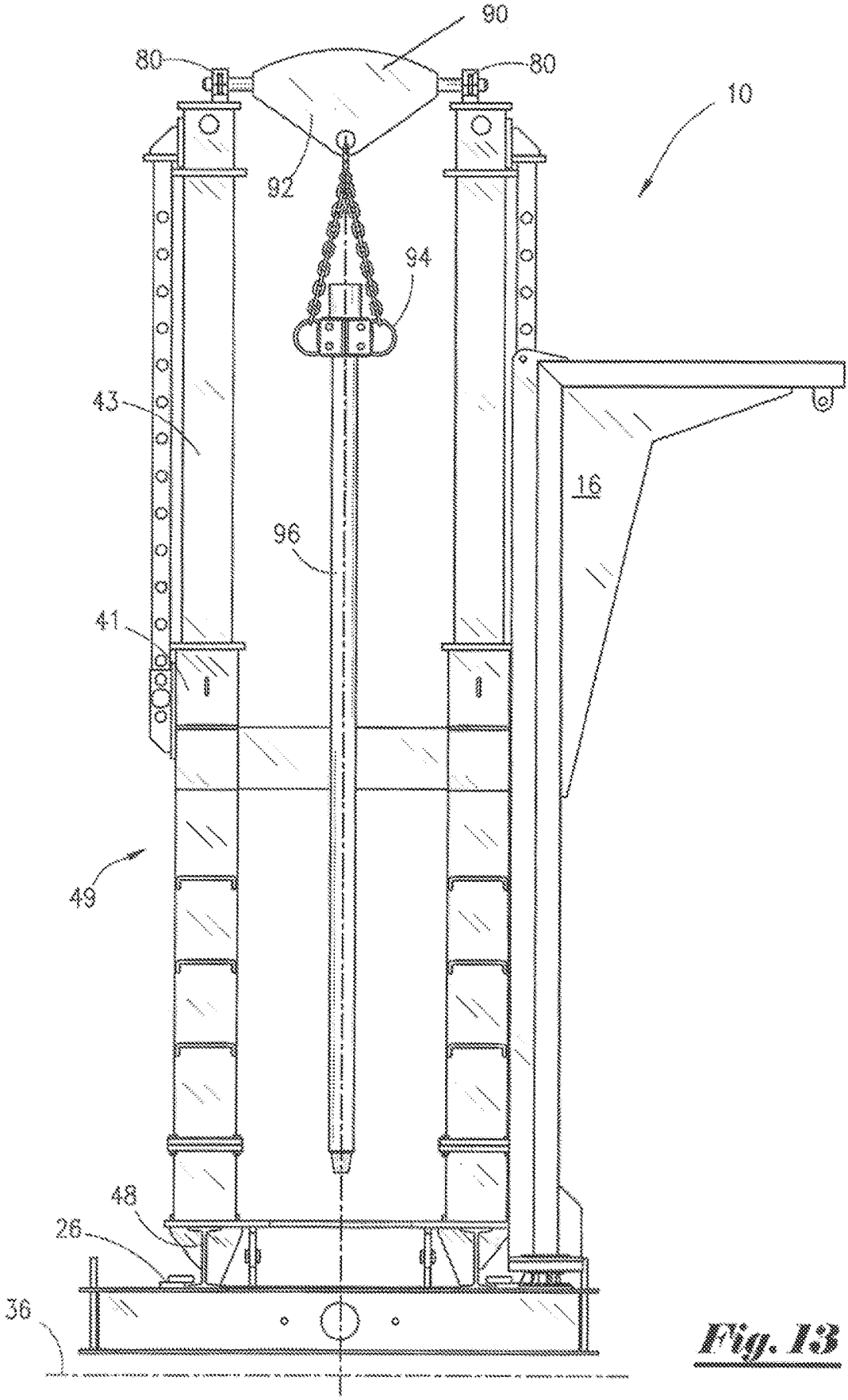

FIG. 13 is a frontal elevation view of the frame assembly showing an elevator lifting assembly adaptation.

Figure 14:
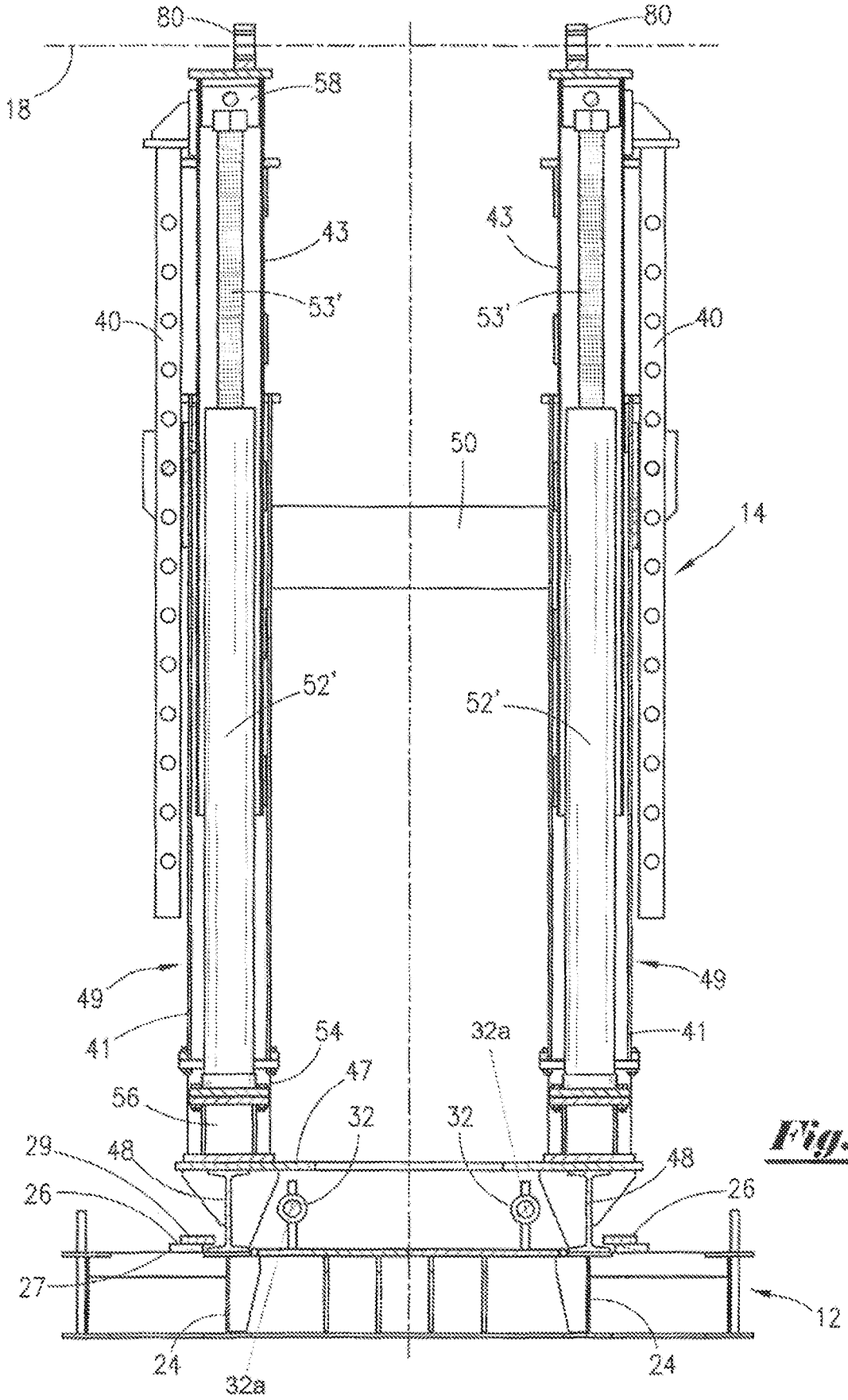

FIG. 14 is an alternate cross section view of the frame assembly shown in FIG. 8 with the column assembles of the mast assembly partially extended by means of a mechanical screw-type actuator.

DESCRIPTION OF THE EMBODIMENT

Figure 1:
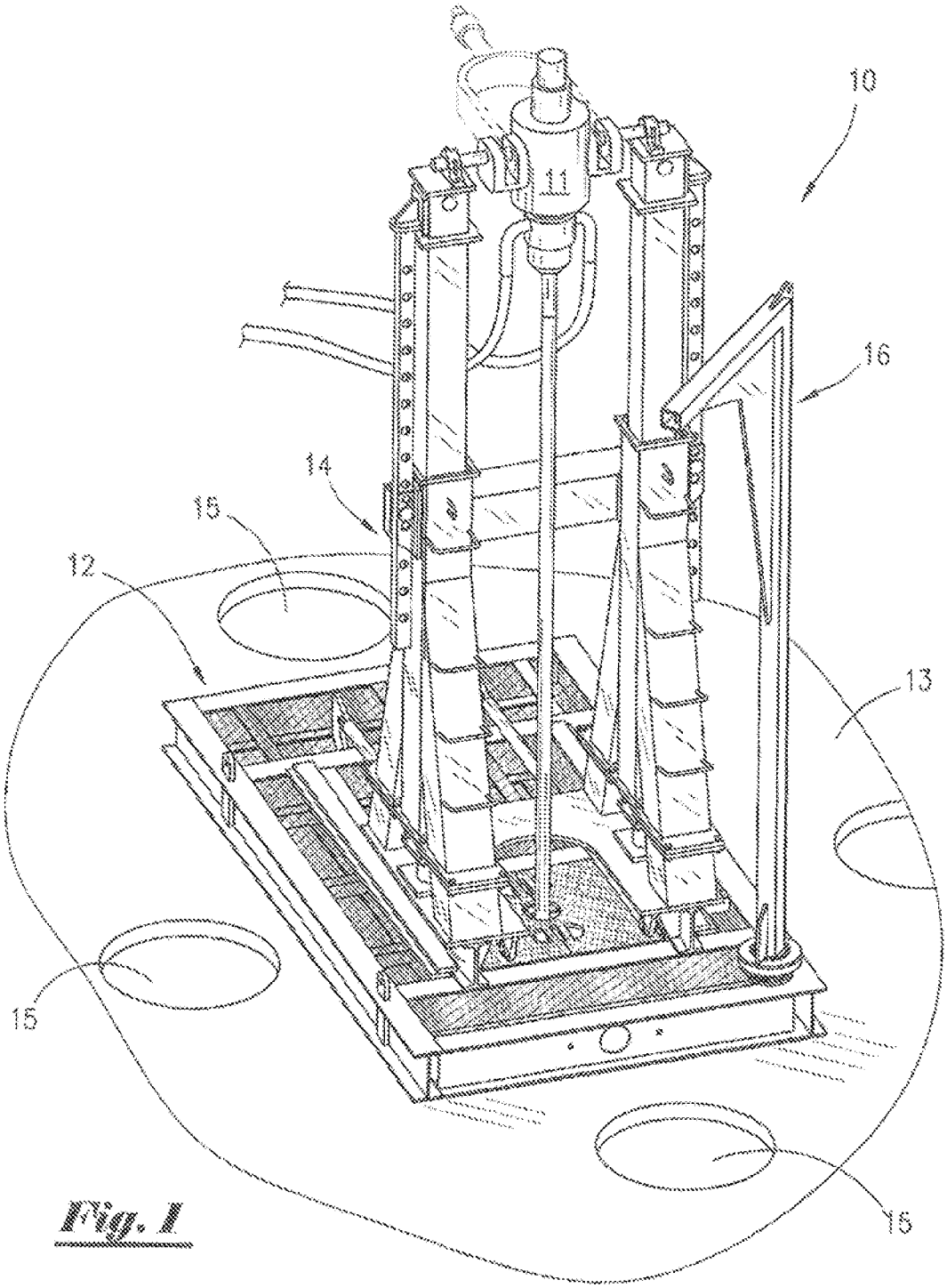
FIG. 1 is a frontal isometric elevation view of the frame assembly located above a deck access opening to a wellhead with the column assemblies of the mast assembly extended vertically.

As first seen in FIG. 1, the frame assembly 10 includes a horizontally oriented skid assembly 12, a vertically oriented, extendable and retractable, mast assembly 14, and a pivotal crane assembly 16 as support for various downhole tools such as optional hydraulic swivel assembly 11. The mast assembly is slidably positionable on the skid frame. The skid assembly 12 is positioned on the well platform deck 13 adjacent to a platform wellhead opening 15.

Figure 2:
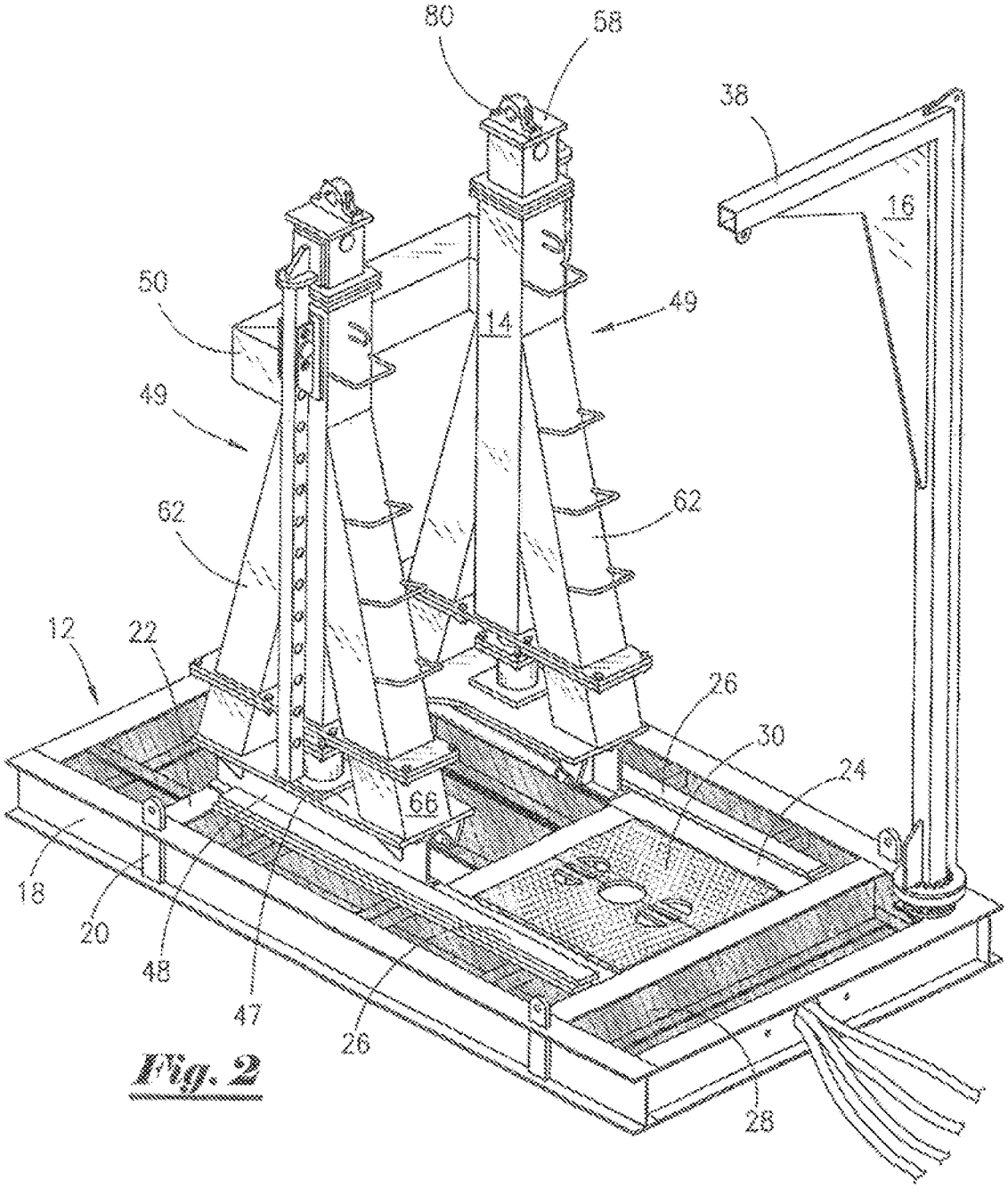
FIG. 2 is a frontal isometric elevation view of the frame assembly with mast assembly traversed forward and with the column assemblies of the mast assembly vertically retracted.

As seen in FIG. 2, the horizontally oriented skid assembly 12 includes a perimeter frame 18, lifting eyes 20, transverse cross members 22, longitudinal support beams 24 that extend longitudinally along the length of the frame, longitudinal guides 26 that correspond to the support beams 24, decking 28 and pivotal deck doors 30. The guide 26 shown is comprised of overlapping stacked plates mounted to the support beams 24. The top surface of each support beam 24 is positioned flush with the decking 28.

The mast assembly 14 is comprised of a substantially U-shaped column base plate 47 that supports at least two vertically oriented, extendable and retractable, tubular column assemblies 49 which are capped by a split-bearing assembly 80. The column assemblies 49 are tied together by a horizontal cross member 50. The column base plate 47 is in turn supported upon longitudinal mast support beams 48.

Guide plates 26 slidable retain the mast support beams 48 directly upon the support beams 24 of the skid assembly 12.

Figure 3:
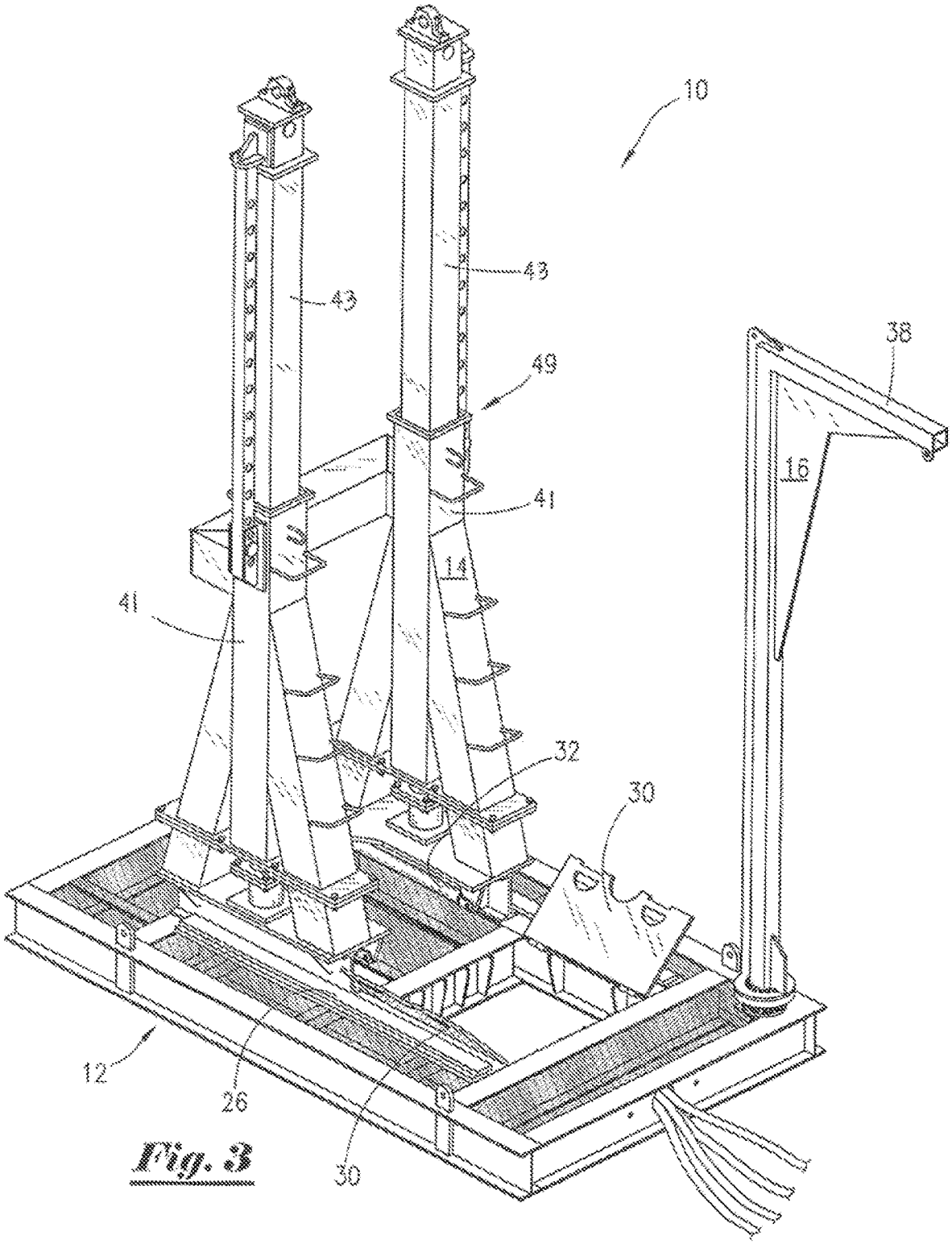
FIG. 3 is a frontal isometric elevation view of the frame assembly with the mast assembly traversed rearward with the deck covers open and with the column assemblies of the mast assembly extended vertically.

As seen in FIG. 3, the mast assembly 14 is traversable in a forward and rearward direction (forward being towards the doors 30) by means of at least one actuator 32 having an extendible and retractable rod 32*a*, shown in section in FIG. 14, that is located above and within the perimeter frame 18 between beams 24. The actuator 32 is horizontally oriented and mounted between the skid assembly 12 and said mast assembly 14 whereby extension retraction of the rod 32*a* will move the mast support beams 48 of the mast assembly 14 along the top of the support beams 24 of the skid assembly 12. The actuators 32 may be hydraulic, pneumatic, or mechanical actuators. Such actuators are thought to be well known. For instance, a horizontally oriented screw-type actuator may be utilized for actuators 32 to traverse the mast assembly in a forward and rearward direction. The deck doors 30 of the skid assembly 12 pivotally open to provide access to the wellhead opening 15. The column assemblies 49 are comprised of a lower tubular column segment 41 configured to telescopically receive an upper tubular column segment 43.

Figure 4:
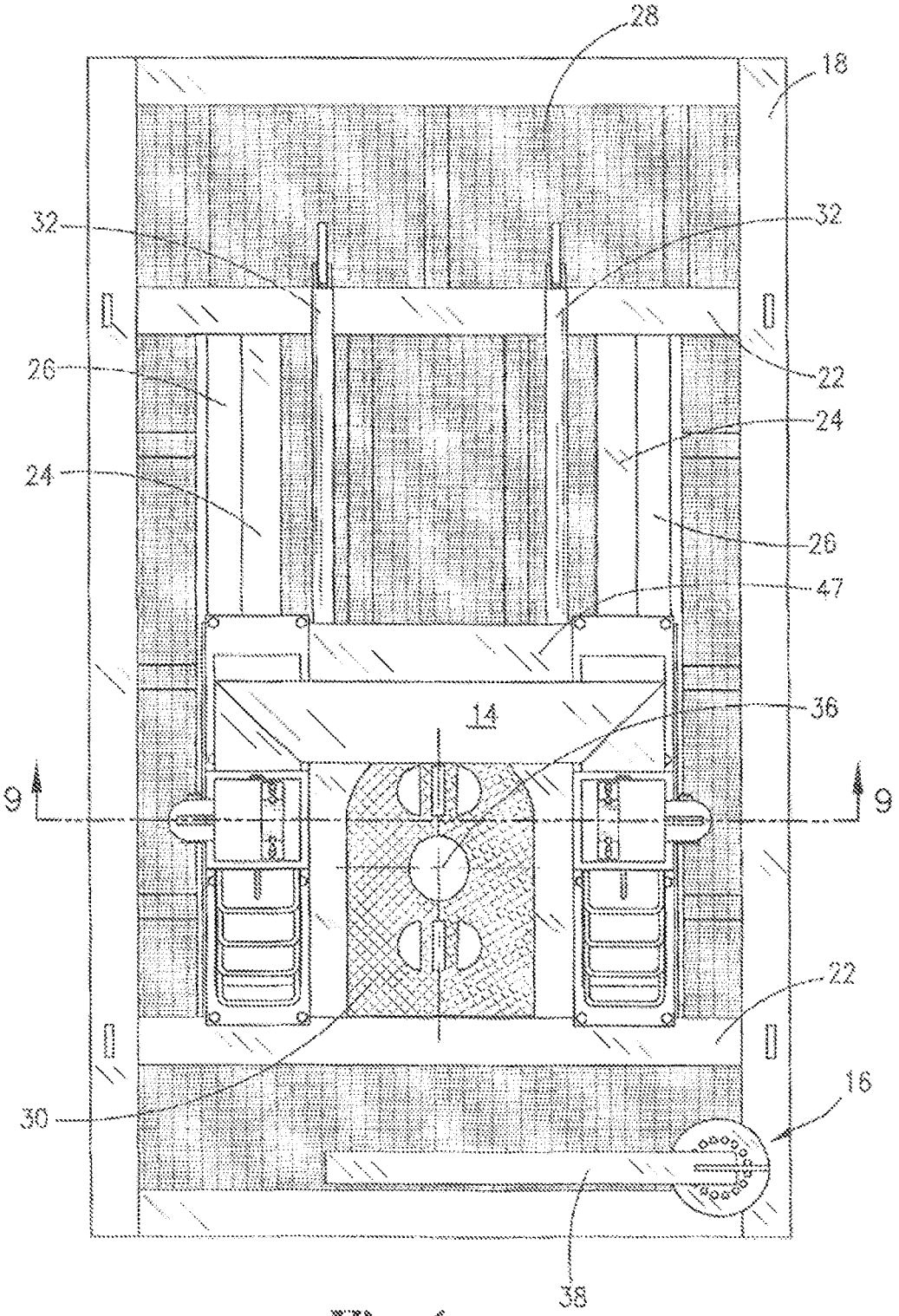
FIG. 4 is a top view of the frame assembly with pivotal crane retracted and mast traversed forward.

As also seen in FIG. 4, a top view of the frame assembly 10, the mast assembly 14 is shown extended forwardly. Here the actuators 32 are extended forward to a position whereby the center line of the split-bearing assemblies 80 on the column assemblies 49 of the mast assembly 14 may be aligned with the wellhead center line 36. The pivotal crane assembly 16 has a right angle pivot arm 38 for supporting a set of tongs (not shown) so as to be aligned with the wellhead centerline 36.

Figure 5:
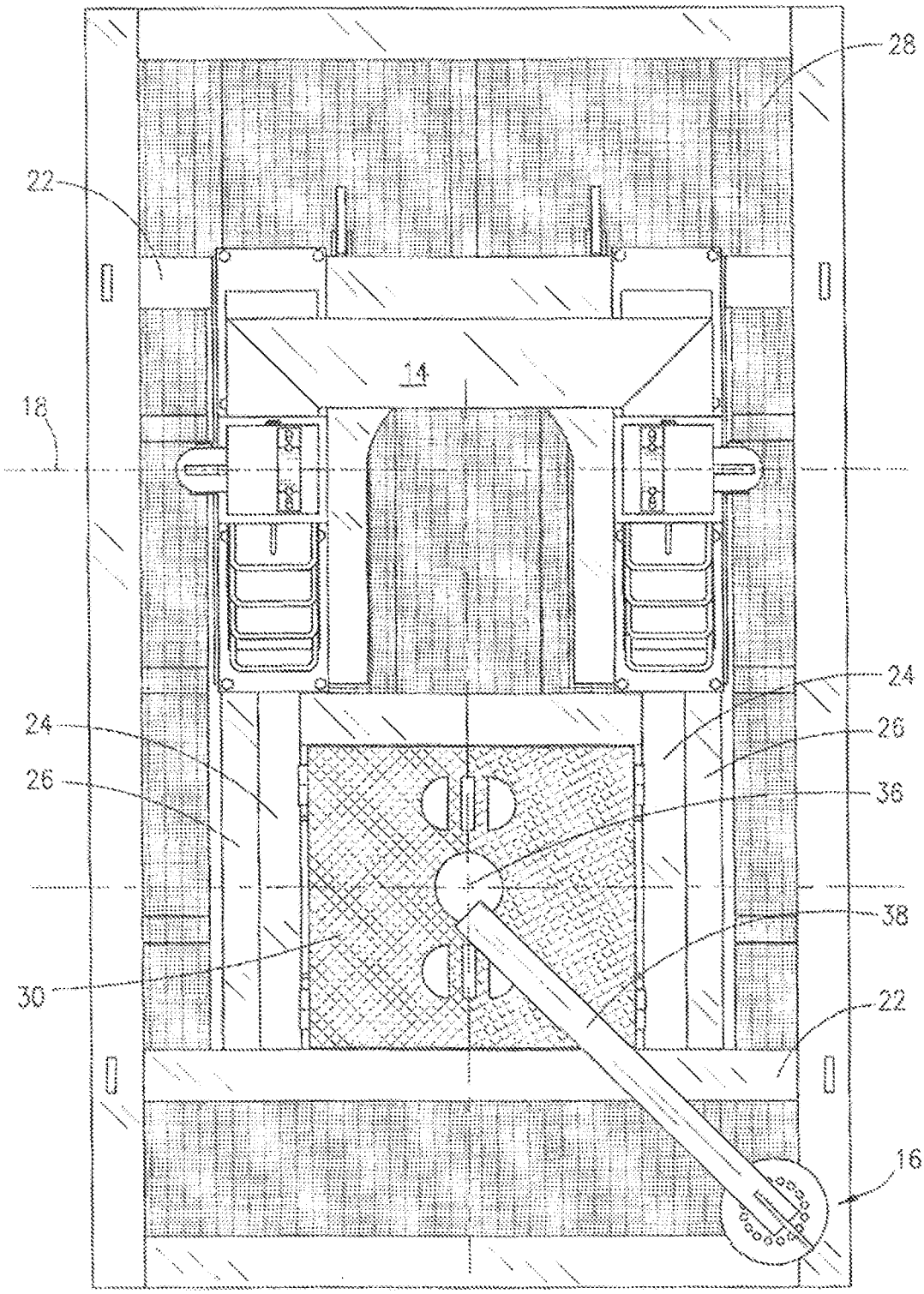
FIG. 5 is a top view of the frame assembly with pivotal crane extended and mast traversed rearward.

As may be seen in FIG. 5, an alternative top view of the frame assembly 10, the mast assembly 14 is shown fully retracted rearward. Here the actuators 32 are retracted rearward to move the mast assembly away from the wellhead centerline 36. The column assembly 49 is arranged to allow plenty of room over the exposed doors 30 of the skid assembly 12 in order to maneuver pivot crane 16 and its pivot arm 38 into position in alignment with the wellhead centerline 36. This arrangement is beneficial in cases where tubing is uncoupled using tongs. When casing is being removed, using bars penetrating the casing (previously discussed but not shown); such bars may be supported by the doors or the top of beams 24.

Figure 6:
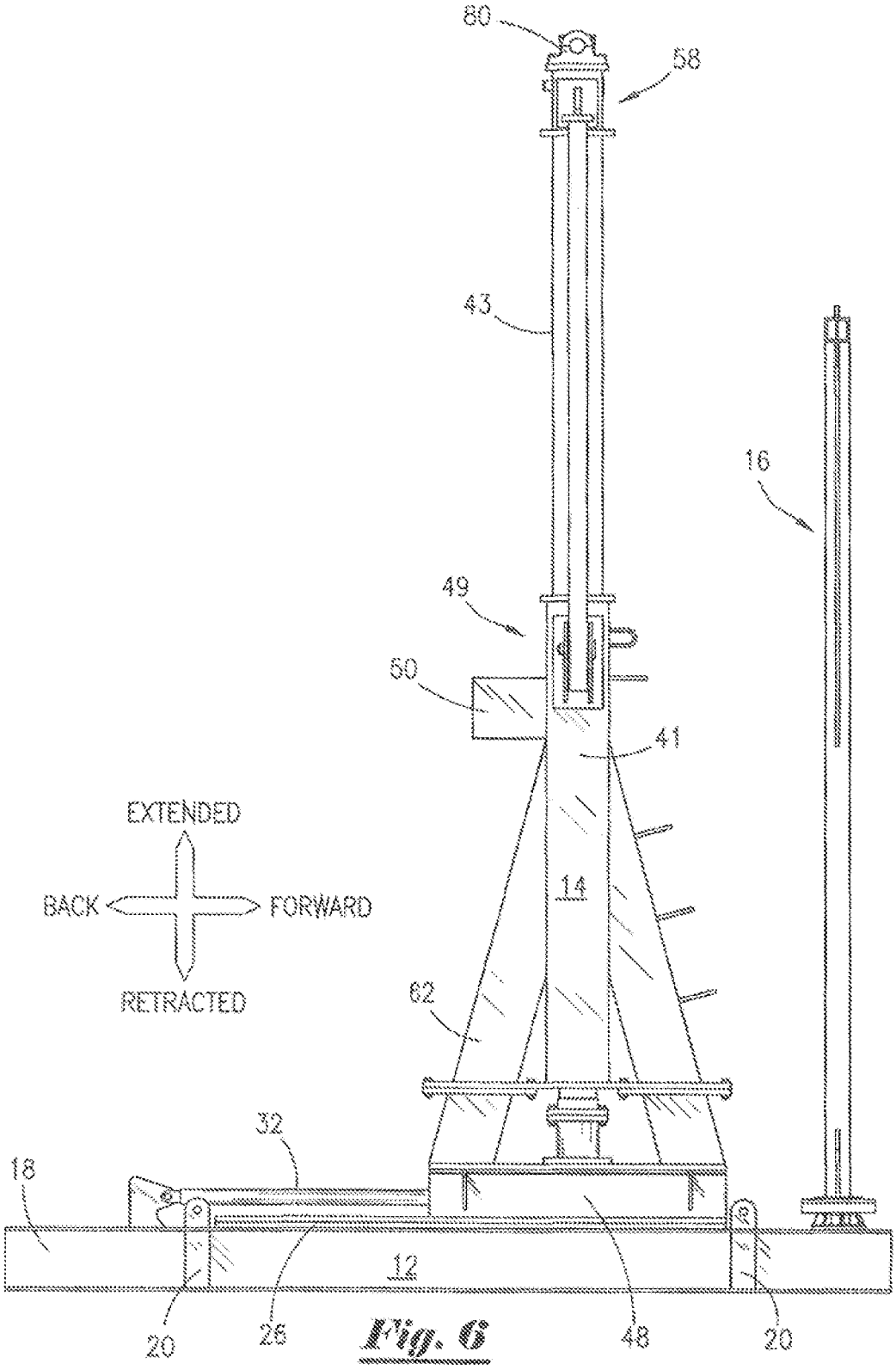
FIG. 6 is a side elevated view of the frame assembly with the mast assembly traversed forward and with the column assembles extended vertically.
Figure 7:
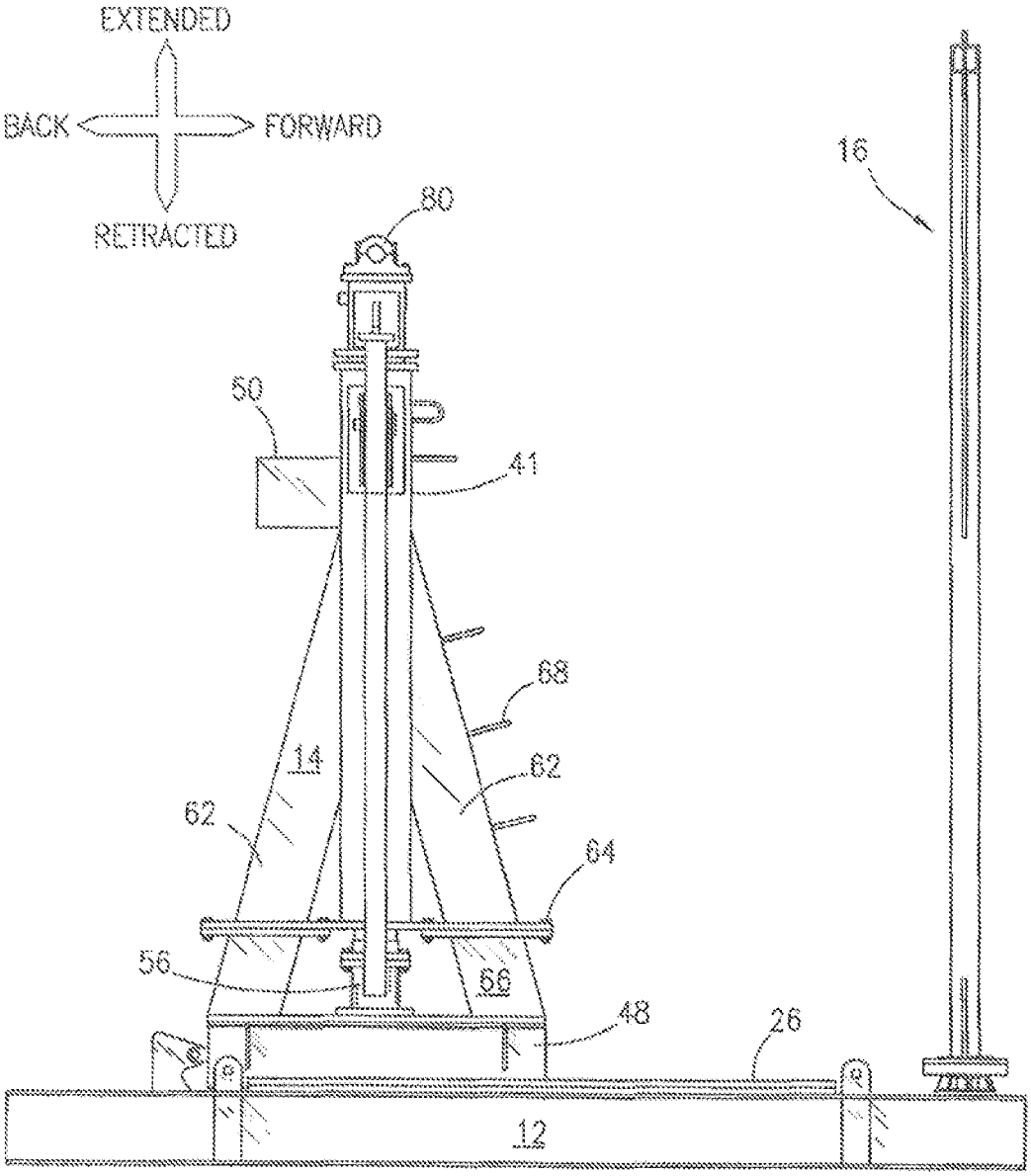
FIG. 7 is a side elevated view of the frame assembly with the mast assembly traversed rearward and with the column assembles retracted vertically.

As seen in FIG. 6, the column assemblies 49 of the mast assembly 14 may be extended by pulling the upper tubular column segment 43 from within the lower tubular column segment 41. The upper tubular column segment 43 may then be pinned in position on the lower tubular column segment 41 at a desired position between the fully retracted position seen in FIG. 7 and the fully extended position seen in FIG. 6. The upper tubular column segment 43 and the lower tubular column segment 41 of each column assembly 49 are configured to fully enclose a mast extension and retraction actuator 52. The actuators 52 may be hydraulic, pneumatic, or mechanical actuators. The column assemblies 49 of the mast assembly 14 may be configured vertically, by means of the actuators 52, from a fully retracted position to a fully extended position, as shown in FIG. 8, or any selected point in between. Stiff legs 4*o* having a plurality of spaced apart selective holes 42 mounted on the outside of each upper column segment 41 and positioned with respect to a stiff leg support bracket 45 mounted on each lower column segment 43. Each support bracket 45 has a hole 46 configured to correspond with a selected hole 42 on stiff legs 40. Holes 42 and 45 are configured to receive pin 44 to retain each upper column segment 43 and the lower column segment 41 of the column assemblies 49 in a desired configuration. The combination of the pins 44 and stiff legs 40 and support bracket 45 allow stress on the upper tubular column segments 43 of the column assemblies 49 to be transferred via pins 44 to the lower tubular column segments 41 of column assemblies 49.

Figure 9:
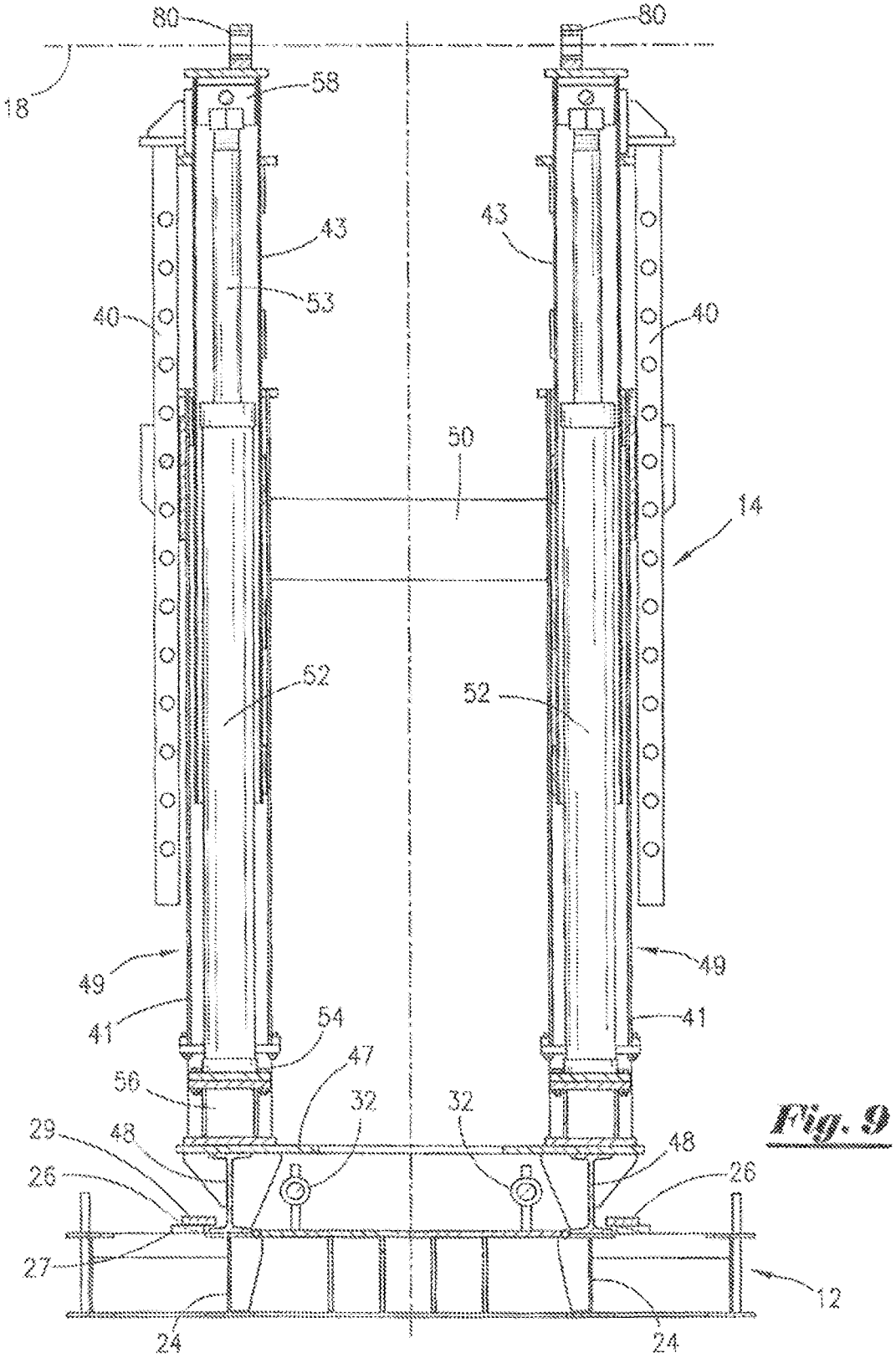
FIG. 9 is a cross section view of the frame assembly shown in FIG. 8 with the column assembles of the mast assembly partially extended.

FIG. 9, a cross section view of the frame assembly shown in FIG. 8, further shows the configuration of the mast assembly 14 and its position with respect to the skid assembly 12. The vertical column assemblies 49 of the mast assembly 14 are tied together by horizontal cross member 50. The horizontal cross member 50 is offset rearwardly, forming a "U" shape, to allow additional clearance on all sides of the vertical centerline of the mast assembly 14. Each vertical column assembly 49 is comprised of the lower tubular column segment 41 configured to telescopically receive the upper tubular column segment 43. Each lower tubular column segment 41 serves to house a vertically oriented internal actuator 52. As seen in FIGS. 2 and 3, cross member 50 has a generally U-shaped opening when viewed from above.

The actuators 52 are rigidly mounted at one end by a flange 54 to a flanged spool member 56 attached to the column base plate 47 at a position over longitudinal mast support beams 48. It is thought that I-beams or wide flange (W) beams will be utilized for the mast support beams 48. The telescopically extending rod end 53 of each actuator 52 is positioned with and pivotally mounted to the upper tubular column segment 43 by rod end assembly 58. Longitudinal mast support beams 48 are positioned upon the skid support beams 24. A flange of each mast support beam 48 is slidably retained and guided along the support beams 24 of the skid assembly 12 by longitudinally extending guides 26. The guide 26 is mounted to the support beams 24. The guide 26 shown is comprised of a plate stack comprised of a bottom plate 27 and an overlapping top plate 29. The top plate 29 of the guide 26 extends over a flange of each mast support beam 48. This allows the mast assembly 14 to be slidable moved forward and rearward by means of sliding the mast support beams 48 along the top of support beams 24 of the skid assembly 12 by action of the actuators 32.

FIG. 14 shows an alternate embodiment of the frame assembly shown in FIG. 8 and FIG. 9. Here each vertical column assembly 49 is comprised of a mechanical screw-type actuator 52' having threaded actuator rod 53' that serves to telescopically extend each upper tubular column 43 from each lower tubular column segment 41.

Returning now to FIG. 7, we see that each vertical lower tubular column segment 41 of the column assemblies 49 includes diagonal bracing members 62. The bracing members 62 are have flanges 64 for attachment of the bracing members 62 to base member assembly 66. A plurality of "U" shaped bars 68, provide steps along one side of at least one diagonal bracing member 62.

Figure 10:
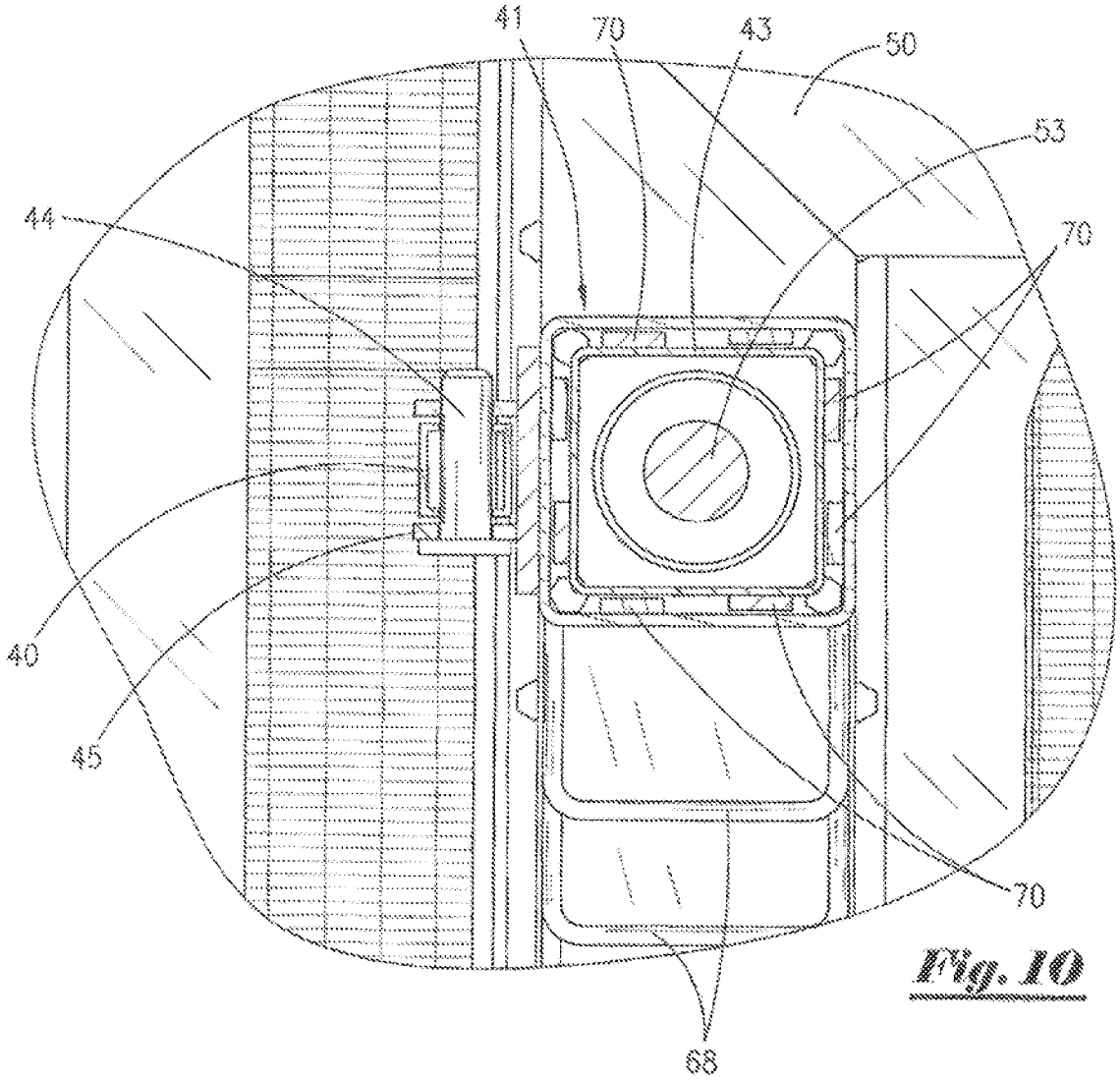

Looking now at FIG. 10, the actuator 52 is shown fully rigidly suspended within the lower tubular column segment 41. It can also be seen that upper tubular column segment 43 is telescopically guided within column segment 41 by wear strips 70. As seen in FIG. 11, the rod end assembly 58 includes an actuator rod nut 72 that is made pivotal via pin 74. Rod end assembly 58 also includes a mounting head 76 attached to upper tubular column segment 43 (not shown) and further supports rod nut 72 via plunger 78. A split-bearing assembly 80 is mounted on the mounting head 76 on each vertical column assembly 49. A more detailed exploded view of the assembly is shown in FIG. 12.

An operational view of the assembly 10 is shown in FIG. 13, utilizing pivotal elevator assembly 90*o* supported by a split-bearing assembly 80. Elevator assembly 90 includes a support member 92 having a shaft extending from each end for support by bearings 80. The support member 92 has a hole therein for supporting an elevator 94, the elevator 94 having slips or other gripping devices (not shown) for gripping and extracting casing 96 from a wellbore. Extension and retraction of the column assemblies 49 of the mast assembly 14 will lift the casing supported on the elevator.

Often it is necessary to mill the surface of a downhole pipe string such as a casing string. The assembly 10 may be situated over a pipe string and used to simulate the weight of a drill collar for such milling purposes. This can be accomplished by providing the column assemblies 49 of the mast assembly 14 with actuators 52 that can provide both an upward and a downward force on the pipe string. Actuators 52 capable of providing both an upward force and a downward force of at least 15 tons, when used with a power swivel as shown in FIG. 1 with an attached milling assembly, would be sufficient for simulating the weight of a drill collar for milling purposes.

When used for milling purposes, the assembly 10 is fitted with a power swivel having an attached pipe milling assembly with associated reaming and cutting equipment. The assembly 1*o* is brought to a desired wellhead location and the mast assembly 14 of the assembly 1*o* is traversed forward and rearward as desired by means of actuator 32 to position the milling assembly over the centerline of the wellhead and the pipe string. The actuators 52 of the column assemblies 49 are then retracted to apply a downward force on said milling assembly for milling of the pipe string.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

I claim:

1. A portable mast assembly comprising:

(a) a horizontally oriented frame having at least two support beams;

(b) a mast assembly having at least two mast beams, each of said at least two mast beams supporting a vertically extending column, each of said at least two mast beams positioned upon and supported by one of said at least two support beams of said horizontally oriented frame;

(c) said at least two mast beams being movable along said at least two support beams of said horizontally oriented frame; and (d) a cross member that connects one of the vertically extending columns to another one of the vertically extending columns, the cross member having a generally U-shaped opening as viewed from above.

2. The portable mast assembly recited in claim 1 further comprising a guide for slidably retaining said at least two mast beams upon said at least two support beams of said horizontally oriented frame.

3. The portable assembly recited in claim 2 wherein a means for moving said at least two mast beams along said at least two support beams of said horizontally oriented frame includes horizontally oriented actuators having an extendible and retractable rod.

4. The portable assembly recited in claim 3 wherein said vertically extending columns of said mast assembly are vertically extendable and retractable.

5. The portable mast assembly recited in claim 4 further comprising a deck surface.

6. The portable mast assembly recited in claim 5 wherein said deck surface has an opening to provide access below said deck surface.

7. The portable mast assembly recited in claim 6 wherein said opening in said deck surface is covered by pivotally mounted doors.

8. The portable mast assembly recited in claim 7 wherein said vertically extendable and retractable mast columns comprise:

a lower tubular column segment;

an upper tubular column segment, said upper tubular column segment slidably positioned relative to said lower tubular column segment; and a vertically oriented actuator having an extendible and retractable rod mounted within each said lower tubular column, said extendible and retractable rod of said vertically oriented actuator being pivotally mounted to said upper tubular column segment.

9. The portable mast assembly recited in claim 8 further comprising:

a pin and hole system comprising at least one hole associated with each said upper column segment and at least one hole associated with each said lower column segment, and support pins configured to be received in the holes whereby each said upper column segment and each said corresponding lower column segment is supported by the pins in a desired configuration.

10. The portable mast assembly recited in claim 1 further comprising a substantially U-shaped column base plate that supports the vertically extending columns, wherein said U-shaped column base plate is supported upon the mast beams.

11. The portable mast assembly recited in claim 2 wherein said guide for slidably retaining said at least two mast beams upon said at least two support beams of said horizontally oriented frame comprises stacked overlapping plates.

12. The portable mast assembly recited in claim 1 further comprising a bearing assembly at the top of each of said vertically extending columns.

13. A portable mast assembly comprising:

(a) a horizontally oriented frame having at least two support beams;

(b) at least two mast beams, each of said at least two mast beams being positioned upon and supported by one of said at least two support beams of said horizontally oriented frame;

(c) a vertically extendable and retractable column supported upon each of said at least two mast beams;

(d) at least one horizontally oriented actuator having an extendible and retractable rod whereby extension and retraction of said rod will move said at least two mast beams along said at least two support beams; and (e) at least two vertically oriented actuators, each of said at least two vertically oriented actuators having an extendible and retractable rod whereby extension and retraction of said extendible and retractable rod extends and retracts said vertically extendable and retractable columns; and (f) a cross member that connects one of the vertically extendable and retractable columns to another one of the vertically extendable and retractable columns, the cross member having a generally U-shaped opening as viewed from above.

14. The portable mast assembly recited in claim 13 wherein each of the vertically extendable and retractable columns has an upper segment and a corresponding lower segment, further comprising:

a pin and hole system comprising at least one hole associated with each said upper column segment and at least one hole associated with each said lower column segment, and support pins configured to be received in the holes whereby each said upper column segment and each said corresponding lower column segment is supported by the pins in a desired configuration.

15. The portable mast assembly recited in claim 14 further comprising a guide for slidably retaining said at least two mast beams upon said at least two support beams of said horizontally oriented frame.

16. The portable mast assembly recited in claim 15 further comprising:

(a) a deck surface on said horizontally oriented frame, said deck surface having an opening to provide access below said deck surface;

(b) doors over said opening, said doors pivotally mounted on said horizontally oriented frame; and (c) a mast support beam spanning between said vertically extendable and retractable columns.

17. The portable mast assembly recited in claim 13 further comprising a substantially U-shaped column base plate that supports the vertically extending columns, wherein said U-shaped column base plate is supported upon the mast beams.

18. A portable mast assembly comprising:

(a) a horizontally oriented frame having support beams;

(b) a mast assembly having at least two vertically extendable and retractable columns, each of said at least two vertically extendable and retractable columns supported on a corresponding mast beam, each said mast beam positioned upon and supported by one of said support beams of said horizontally oriented frame; and (c) at least one horizontally oriented actuator having an extendible and retractable rod, whereby extension and retraction of said rod of said horizontally oriented actuator will slide said mast beams of said mast assembly along said support beams of said horizontally oriented frame; and (d) a cross member that connects one of the at least two vertically extendable and retractable columns to another one of the at least two vertically extendable and retractable columns, the cross member having a generally U-shaped opening as viewed from above.

19. The portable mast assembly recited in claim 18 further comprising:

(a) a decking surface supported on said horizontally oriented frame wherein said deck surface has an opening providing access below said deck surface and whereby extension and retraction of said rod of said horizontally oriented actuator will slide said mast beams along said support beams of said horizontally oriented frame for alignment with said deck surface opening;

(b) at least two vertically oriented actuators, each of said at least two vertically oriented actuators having an extendible and retractable rod whereby extension and retraction of said extendible and retractable rods extends and retracts said at least two vertically extendable and retractable columns; and (c) a mast support beam spanning between said at least two vertically extendable and retractable columns.

20. The portable mast assembly recited in claim 18 further comprising a substantially U-shaped column base plate that supports the vertically extending columns, wherein said U-shaped column base plate is supported upon the mast beams.

* * * * *